US009869523B2

(12) United States Patent
Lau

(10) Patent No.: US 9,869,523 B2
(45) **Date of Patent: *Jan. 16, 2018**

(54) COMPACT SPACE-SAVING GUN SILENCER

(71) Applicant: Michael Lau, Bayside, NY (US)

(72) Inventor: Michael Lau, Bayside, NY (US)

(73) Assignee: Michael Lau, Bayside, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/628,503

(22) Filed: Jun. 20, 2017

(65) Prior Publication Data

US 2017/0284759 A1 Oct. 5, 2017

Related U.S. Application Data

(60) Continuation of application No. 15/261,391, filed on Sep. 9, 2016, now Pat. No. 9,714,805, which is a continuation-in-part of application No. 15/072,482, filed on Mar. 17, 2016, now Pat. No. 9,464,858, which is a division of application No. 14/731,616, filed on Jun. 5, 2015, now Pat. No. 9,322,607.

(60) Provisional application No. 62/008,260, filed on Jun. 5, 2014.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34; F41A 21/36; F41A 21/38; F41A 21/40; F41A 21/42
See application file for complete search history.

(56) References Cited

U.S. PATENT DOCUMENTS

| | | | |
|---|---|---|---|
| 1,111,202 | A | 9/1914 | Westfall |
| 1,860,276 | A | 5/1932 | Luce |
| 1,187,581 | A | 6/1961 | Weil |
| 4,384,507 | A | 5/1983 | Finn |
| 5,029,512 | A | 7/1991 | Latka |
| 5,123,329 | A | 6/1992 | Irwin |
| 6,276,251 | B1 | 8/2001 | Downing |
| 8,939,057 | B1 | 1/2015 | Edsall |
| 2011/0088540 | A1 | 4/2011 | Brittingham |
| 2016/0290754 | A1 | 10/2016 | Davis |

FOREIGN PATENT DOCUMENTS

| | | |
|---|---|---|
| DE | 3241986 | 5/1984 |
| GB | 2162929 | 2/1986 |
| RU | 2064153 | 7/1996 |
| RU | 2119139 | 9/1998 |
| WO | 2014/041383 | 3/2014 |

*Primary Examiner* — Gabriel J. Klein

(57) ABSTRACT

A compact silencer (suppressor) device for a firearm comprising of multiple chambers which trap the gases from a projectile exiting the barrel of a gun to slow down the gases and reduce the temperature, sound, and flash associated with the projectile. In one embodiment, the first chamber which attaches to the barrel of the firearm comprises of sound baffling materials or gas porting baffles which vent gases from the second chamber passing rearward. The second chamber comprises of a chamber which can accommodate a retractable third chamber of the device, the second and third chamber of the device can have sound baffles to slow down the gases from the projectile.

14 Claims, 6 Drawing Sheets

COMPACT SPACE-SAVING GUN SILENCER

CROSS-REFERENCE TO RELATED APPLICATION

This non-provisional patent application is a Continuation application of, and claims the benefit of priority from United States U.S. non-provisional patent application Ser. No. 15/261,391 titled 'COMPACT SPACE-SAVING GUN SILENCER' filed on Sep. 9, 2016, which claims the benefit of priority from United States U.S. non-provisional patent application Ser. No. 15/072,482 filed on Mar. 17, 2016, now issued as U.S. Pat. No. 9,464,858, which claims the benefit of priority from U.S. non-provisional patent application Ser. No. 14/731,616 filed on Jun. 5, 2015, now issued as U.S. Pat. No. 9,322,607, which claims the benefit of priority from Provisional U.S. application No. 62/008,260 filed on Jun. 5, 2014, the entire disclosures of which are hereby incorporated herein by reference in their entirety.

BACKGROUND

Firearm silencers are well known in the art of weaponry, and a variety of construction methods and materials have been proposed for minimizing the noise associated with expanding gases created or produced from the firing of a weapon. Sound energy is produced when the propellant in a cartridge (or shell) is ignited to force the bullet or shotgun projectile down the muzzle of a firearm. Silencers (also known as suppressors) for firearms operate on the principles of converting a portion of this sound energy into heat energy by diverting or trapping the pressurized gas in chambers within the silencer body. The pressurized gas is forced to expand into the spaces within the silencer, thereby decreasing the pressure, velocity and temperature of the gases prior to their release into the atmosphere or external environment.

A major advantage of using a silencer is hearing protection for the firearm user and bystanders. This is especially important in a home defense situation where the confined walls reflect sounds and resulting hearing damage can be more pronounced. In addition, the use of a silencer helps to conceal the location of a firearm, which may be useful in military, police, and sporting, hunting, and/or other shooting situations. The delayed-release of the propellant gases may also reduce the recoil of the firearm and even increase the precision of a rifle by the redirection of the exhaust gases to offset muzzle flip.

The result is that a firearm silencer can absorb and reduce the audible frequencies, vibrations, and contain or reduce muzzle flash resulting from the rapid expansion of gases leaving a firearm muzzle as a projectile exits the gun bore. However, for silencers to effectively contain and subsequently divert expanding gases and other combustion by-products emitted from the muzzle of a firearm, the silencer (suppressor) may require excessively large (volume) and cumbersome cylinders or tubes, especially with higher caliber firearms.

Therefore, in order to effectively suppress the sound of a firearm, a silencer (or suppressor) must have an internal volume large enough to capture gases emitted from the firearm before releasing the cooled gases to the atmosphere. The larger the internal volume of the silencer, the greater amount of sound can be suppressed, and so it is desirable to increase the size of the silencer for effective sound suppression. However, to achieve this, with conventional concentric, cylindrical suppressors having a desired internal volume, the outer diameter of the suppressor becomes too large and the suppressor can interfere with sight lines of the firearm. Additionally, with conventional concentric, cylindrical suppressors having a smaller outer diameter tube would then result in a longer silencer which impacts the overall length of the firearm.

Current gun silencers use a fixed length chamber to suppress the sound of a projectile as said projectile exits a gun barrel. The elements in the chamber are stationary and function to channel, absorb, or delay sound waves through the fixed chamber; hence the overall length of the silencer is fixed and can be too long, thereby impacting the overall length of the firearm. In view of the preceding, there is a need for a firearm silencer or sound suppressor having an effective internal volume that does not burden the firearm by adding unnecessary length to the barrel of the gun.

Therefore, a need exists to overcome the problems with the prior art as discussed above.

SUMMARY OF THE INVENTION

The present invention is a silencer (or suppressor) for a firearm which is intended for reducing the sound and flash signature of the host firearm. The invention overcomes the above-noted and other deficiencies of the prior art by providing a firearm silencer and methods for manufacturing and fastening a silencer onto a firearm that has a very compact reduced form factor (or length) which has significant benefit to the operability and maneuverability of the firearm.

This silencer (or suppressor) can be mass-produced and, therefore, lowers costs dramatically while still providing a design which is compact space-saving and achieves a level of sound suppression comparable to prior art larger silencers.

The invention creates the novel silencer in one embodiment, with a minimum of three parts or chambers longitudinal to the firearm through which a projectile travels in a concentric manner through the silencer along a center line bore. The first chamber comprises a cylindrical housing, a mount, with means for attachment of a firearm barrel to the proximal end of the cylindrical housing, the silencer being mounted (or securely affixed) to the barrel of the firearm. This attachment to the barrel can be done with a standard screw mount or a quick detach method (such as a three lug twist connect method) which would maintain the alignment of the bore of the firearm to the through hole passage of the silencer.

This first chamber has an inner tube along a centerline bore through which the projectile passes through to the second chamber, the distal end of first chamber has a boundary surface which has holes for gases from the second chamber to be vented rearward back through the first chamber. The first chamber has a baffle chamber that can be filled with gas porting baffles or sound absorbing materials.

The proximal end of the second chamber is connected to the distal end of the first chamber with a boundary that has holes for venting gases from the barrel of the firearm rearward through the first chamber. The second chamber houses a third chamber which is partially (or fully) retracted into the second chamber by a concentric spring.

The third chamber is a cylindrical housing concentric and smaller in diameter to the second chamber thereby allowing the third chamber to expand or retract back into the second chamber in a piston action. The third chamber is partially or can be fully held in a retracted position inside the second chamber by a spring in a concentric shape between the boundary of the second and third chamber. The third chamber has an inner tube which is in line with the barrel of the firearm and acts as a through bore for the projectile to pass from the firearm barrel through the second and third chamber and is also in line with the through bore of the first chamber. The third chamber inner tube is perforated or has vent holes to allow gases to vent from the inner tube to the outer chamber.

When a projectile (such as a bullet or shotgun shell) is fired from a gun, the projectile exits the barrel of the firearm and enters the proximal end of first chamber. Since the first chamber inner tube has no perforations or vent holes, the projectile and the gases pass through and exit the distal end of the first chamber and into the proximal end of the second chamber. The projectile passes through the second and third chamber along the third chamber inner tube and exits the silencer at the distal end of the third chamber. Moreover, when the gases following the projectile enter the second chamber along the inner tube of the third chamber, the gases quickly vent out through the holes of the inner tube the large cavity of the second and third chamber. The pressure of these gases then expand and causes the third chamber to expand distally outward like a piston from the second chamber and in line with the projectile, greatly increasing the volume to contain the exhausted gases and maintaining control of the timing, flow, and direction of these gases on how then vent to the outside.

The expanding gas then pushes the retracted third chamber longitudinally outward, distally away from the barrel of the firearm like a piston, thereby expanding the combined volume of the combine second and third chambers. Then the portion of emitted gas caught in the expanded second and third chamber is re-directed to flows rearwards (proximally to the barrel) towards the first chamber. Some portion of the gas also exits through the bore hole at the distal end of the third chamber. The first chamber is proximal to the second and third chamber with through-hole openings formed in the end cap between the two chambers. This gas flow pathway traveling rearward (proximally to the barrel) of the claimed silencer device allows the gases discharged from the barrel of the firearm to exit into the atmosphere in a controlled manner which reduces heat, sound, and flash of the projectile. As the gases are vented backward, the third chamber begins to retract back into the second chamber by the compression spring.

This piston action by the silencer allows the device to maintain a very compact form factor (length) on the firearm for the vast majority of the time. When a projectile is fired, the silencer momentarily expands the third chamber to accommodate the gases in a controlled manner, and then retract back to a compact length. This allows the silencer to be manufactured and mounted onto a firearm in an extremely compact form factor and still performs the sound suppression function similar to that of a much larger comparable device.

In multiple embodiments of the novel silencer invention, the positioning of the first chamber can be longitudinal to the second chamber and attached to the end of the barrel, or the first chamber can be attached in parallel to the second chamber. The first chamber can be longitudinally and radially connected to the second chamber and extend and encompassing over the barrel and radially aligned to the bore line of the barrel.

These, and possibly other defects of the previously known silencers, are remedied by the present silencer, which is characterized by three or more separate chambers being formed longitudinally in the silencer, the silencer being mounted (or securely affixed) to the barrel of the firearm.

Although the invention is illustrated and described herein as embodied in a firearm silencer and methods for manufacturing and fastening a silencer onto a firearm, it is, however, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale. Further, it is noted that the figures have been created using a computer-aided design computer program. This program at times removes certain structural lines and/or surfaces when switching from a shaded or colored view to a wireframe view. Accordingly, the drawings should be treated as approximations and be used as illustrative of the features of the present invention.

Before the present invention is disclosed and described, it is to be understood that the terminology used herein is for the purpose of describing particular embodiments only and is not intended to be limiting. The terms "a" or "an", as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

In this document, the term "longitudinal" should be understood to mean in a direction corresponding to an elongated direction of the silencer or firearm. The term "distal" end should be understood to mean the section farthest from the barrel of the firearm. The term "proximal" end should be understood to mean the section closest to the barrel of the firearm.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to further illustrate various embodiments and to explain various principles and advantages all in accordance with the present invention.

DETAILED DESCRIPTION

Herein various embodiment of the present invention are described. In many of the different embodiments, features are similar. Therefore, to avoid redundancy, repetitive description of these similar features may not be made in some circumstances. Furthermore, the described features, structures, or characteristics may be combined in any suitable manner in one or more embodiments. In other instances, well-known structures, materials, or operations are not shown or described in detail to avoid obscuring aspects of the invention. It shall be understood, however, that description of a first-appearing feature applies to the later described similar feature and each respective description, therefore, is to be incorporated therein without such repetition.

Figure 1:
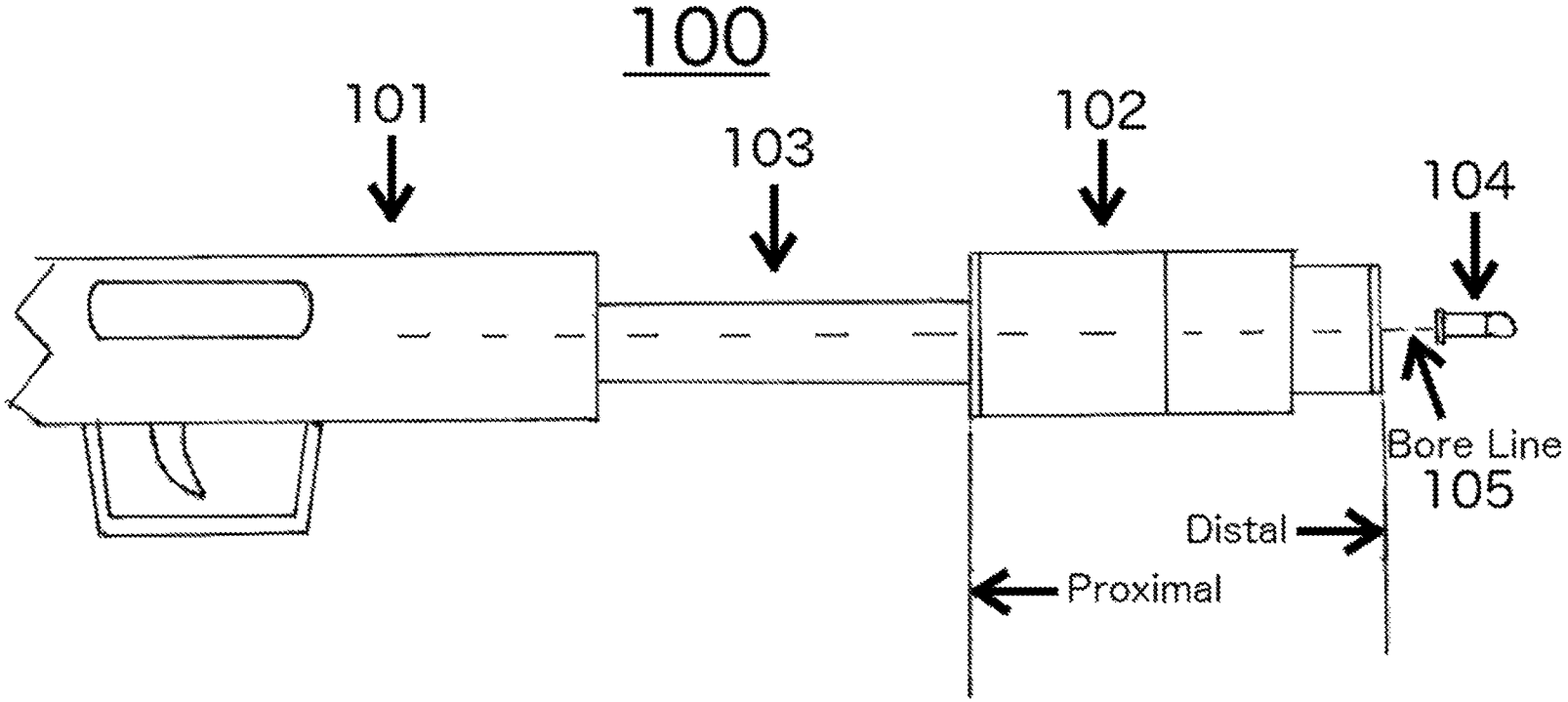
FIG. 1 shows block diagrams illustrating the major functional blocks and their relative position of a firearm and the Silencer (Suppressor) Apparatus in the first embodiment.

A silencer or noise suppressor for a firearm utilizing concepts of the invention is illustrated in FIG. 1. The silencer (102) can include a cylindrical body having a cylindrical bore proximally attached to the barrel (103) of a firearm (101) axially extending to the distal end of the silencer where a projectile (104) would exit the silencer. The silencer (102) bore is sized to allow connection to a firearm and to permit passage of a projectile. The silencer (102) can be threaded for at least a portion of its length and can be attachable with a standard threaded screw mount or a quick detach method (such as a three lug twist connect method) or other commonly used mechanical attachment methods which maintain the common bore line (105) [or center line] of the barrel (103) to the silencer assembly, thereby rendering the silencer (102) selectively installable and removable from the weapon or firearm. A firearm barrel (103) is the portion of a firearm or weapon that directs a fired projectile and the muzzle is the end portion of the barrel. The terms weapon, gun, shotgun, and firearm will be used interchangeably herein.

The silencer (102) according to the present invention is preferably made of aluminum; however other suitable material such as titanium, steel, other metal or alloy, synthetic material etc. can be used for the manufacture of this silencer. Sound absorbing materials can include aluminum chips, steel mesh or steel wool, or other suitable silencing material. Baffles can include one or more metal or plastic or composite baffles having conical sections and ports and other structures designed to direct and/or port gases, by-products of combustion and sound energy in such a fashion as to reduce the sound energy and muzzle flash emitted from the silencer in conjunction with the firing of a projectile.

Figure 2:
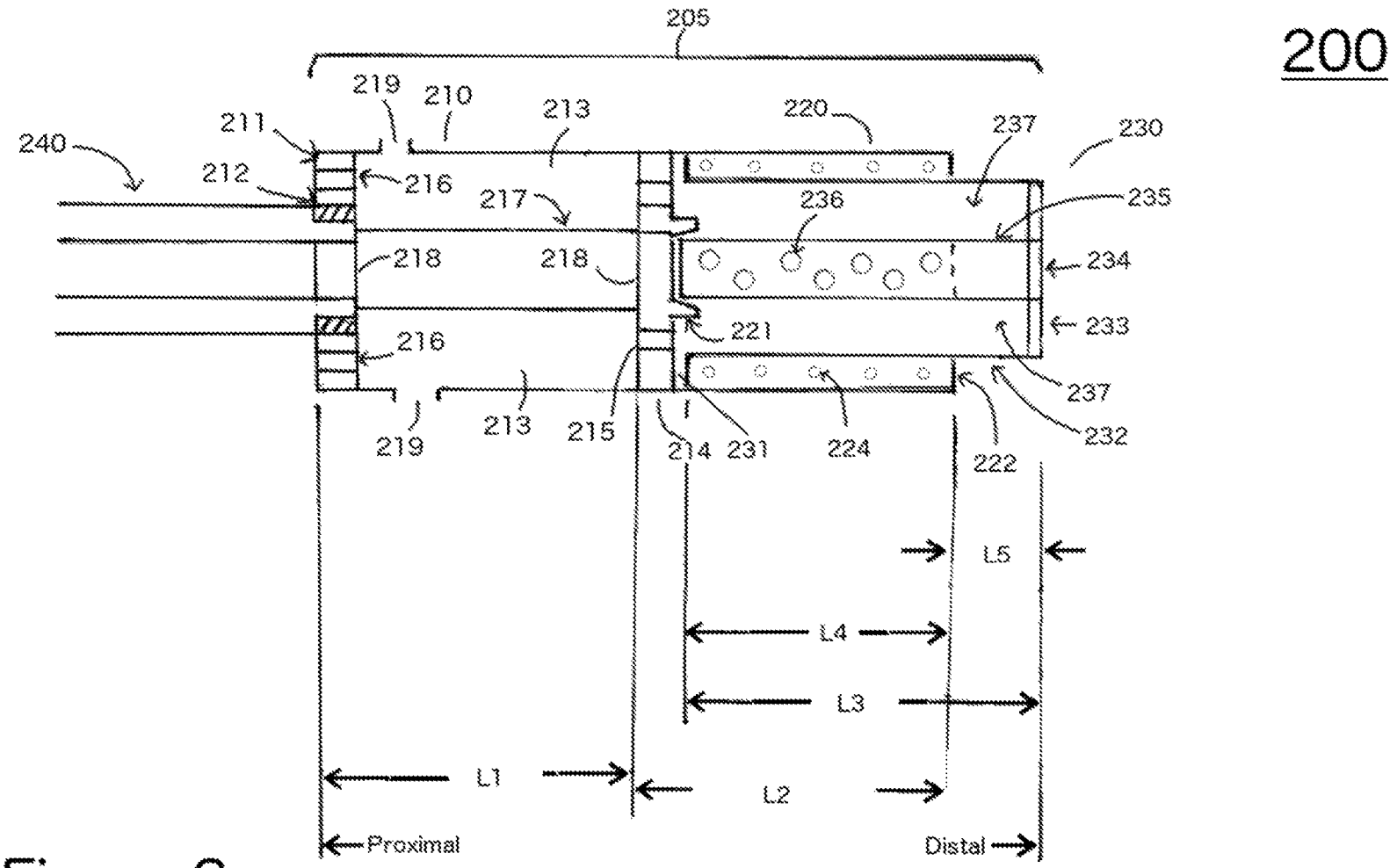
FIG. 2 shows block diagrams illustrating the major functional blocks of the Compact Space-saving Silencer (Suppressor) with the third chamber in the retracted compact position.

More specifically, FIG. 2 is a sectional view of the first embodiment of the gun silencer (205) in a retracted state. The silencer (suppressor) is made of at least three chambers including a first chamber (210), a second chamber (220), and a third chamber (230) partially retracted into the second chamber (220).

In one embodiment, the cylindrical shaped first chamber (210) includes a threaded end cap (211) configured to be secured to threads (212) on a barrel of a firearm (240). The threaded end cap (211) is one embodiment that may be employed for the securement of silencer apparatus to the barrel of the firearm, other methods may include quick disconnect methods such as a three lug mount or any other known method that would maintain the alignment and bore of the firearm to the silencer and maintain a straight through hole path for the projectile. As shown, the threaded end cap (211) has an annular aperture (218) that allows a projectile to freely pass through the first chamber. The first end cap (211) is proximal to the barrel and the second end cap (214) is distal to the barrel. The first chamber has a solid inner tube (217) with openings (218) on the distal and proximal ends of the first chamber at endcaps (211 & 214). The projectile and the gases are flowed outward from the barrel (240) though the first chamber (210) and into the second chamber (220) and third chamber (230). The size of the aperture opening (218) is configured with a diameter that is the same or greater than the diameter of a projectile and would allow for unrestricted passage and exit from the barrel of the firearm through the claimed silencer apparatus. Accordingly, the threaded end cap (211) is configured to securely attach to the barrel of the firearm (240) and sized to receive a projectile exiting the barrel.

Several features have been designed into the first chamber to reduce the noise of a firearm discharge. The discharging firearm with projectile and expanding gases are passed from the first chamber (210) into the second chamber (220) and through the third chamber (230) to the distal end of the silencer (205) along the bore line.

When a projectile (such as a bullet or shotgun shell) is fired from a gun, the projectile exits the barrel of the firearm (240) and enters the proximal end of first chamber through the first end cap (211). Since the first chamber inner tube (217) has no perforations or vent holes, the projectile and the gases pass through and exit the distal end of the first chamber through second end cap (214) and into the proximal end of the second chamber (220). The projectile passes through the second and third chamber along the third chamber inner tube (235) and exits the silencer at the distal end of the third chamber through third end cap (233). Moreover, when the gases following the projectile enter the second chamber along the inner tube of the third chamber (235) which is perforated with vent holes, the gases quickly vent out into the large cavity of the second and third chamber. The pressure of these gases then expand and causes the third chamber (230) to expand distally outward like a piston from the second chamber (220) and in line with the projectile, greatly increasing the volume which functions to contain the exhausted gases and maintaining control of the timing, flow, and direction of these gases on how they vent to the outside.

One element of sound reduction in the first chamber (210) is that the expanding gases captured by the second chamber (220) and third chamber (230) are redirected rearward to the first chamber (210) through vents (215) in the second end cap (214). This redirection more effectively utilizes the noise suppressor's internal volume of the first chamber (210) thereby providing more time for the gases to cool. Another element of sound reduction for the first chamber is that the internal volume of the first chamber (213) can be empty or filled with sound absorbing materials or sound baffles. Turbulence is created by this venting of gases through the first chamber (with either empty, sound absorbing materials or baffles), allowing the associated gases more time to cool and expand thereby reducing the sound and flash signature of the host firearm. Another element of sound reduction is the gases can be vented in multiple directions such as through vent holes (216) at the first end cap (211) or can be upward or downward through side vent holes (219). The choice of selecting an upward venting of gas can be used to offset muzzle flip of the barrel as the projectile is fired. A downward direction of the gases could be used to better conceal the sound and location of the firearm.

The second chamber (220) has a cylindrical shape of same diameter to the first chamber (210) and is connected to the end cap (214) on the proximal end and has an opening on the distal end flanges (222) or ridge edge concentric to accommodate the third chamber (230) which can expand or contract longitudinally into the second chamber (220). The second cylinder has a concentric spring (224) which compresses the third chamber (230) into the second chamber (220). The spring (224) concentric with the second chamber (220) and third chamber (230) utilizes the end flanges of the second chamber (222) and end flanges or ridges of the third chamber (231) to hold the chambers in a normally retracted position. The second chamber (220) has a concentric alignment guide ring (221) mounted on the end cap (214) with the bore which will be further discussed for the functions involving the third chamber (230).

The third chamber (230) has a cylindrical shape concentric to the second chamber (220) and smaller in diameter such that the third chamber (230) can retract partially or wholly into the second chamber (220). The proximal end of the third chamber (230) contains an end flange or ridge (231) which extends radially outward from the cylinder body (232) and fits into the inside diameter of the second chamber (220), this end flange or ridge contacts the concentric spring (224). The distal end of the third chamber (230) has a third end cap (233) which has an opening (234) concentric with the bore and is large enough to allow the passage of the projectile from the firearm to pass through. The third chamber (235) has an inner tube (235) concentric with the bore and wide enough to allow the passage of a projectile to pass through freely. The inner tube (235) can be partially or fully vented with holes (236) extending radially away from the bore and allows gases to vent from the inner tube (235) to the outer section of the third chamber (230). The internal volume of the third chamber (237) can be empty or filled with sound absorbing materials or sound baffles. Turbulence is created by this venting of gases through sound absorbing materials or baffles, allowing the associated gases more time to cool and expand thereby reducing the sound and flash signature of the host firearm.

The second chamber (220) with a distal second end cap (214) has an alignment guide ring (221) which holds the third chamber inner tube (235) in line with the bore in the retracted position. This alignment guide ring (221) can have a beveled or angled inner surface such that the inner tube (235) can be self-centered in the retracted position. This allows for an accurate alignment of the various elements of the silencer to the bore line and ensures the projectile will pass through these elements freely.

Regarding FIG. 2, if in the retracted state, the third chamber (230) can be designed to be fully retracted into the second chamber (220). Then the length (L3) of the third chamber is smaller than the length of the second chamber (L2) and hence the extension length (L5) would be zero.

If in the retracted state, the third chamber (230) is designed not to fully retract into the second chamber (220), then the length (L3) of the third chamber is larger than the length of the second chamber (L2) and the extension length (L5) would be the amount that the third chamber (230) extends beyond the second chamber (220).

Figure 3:
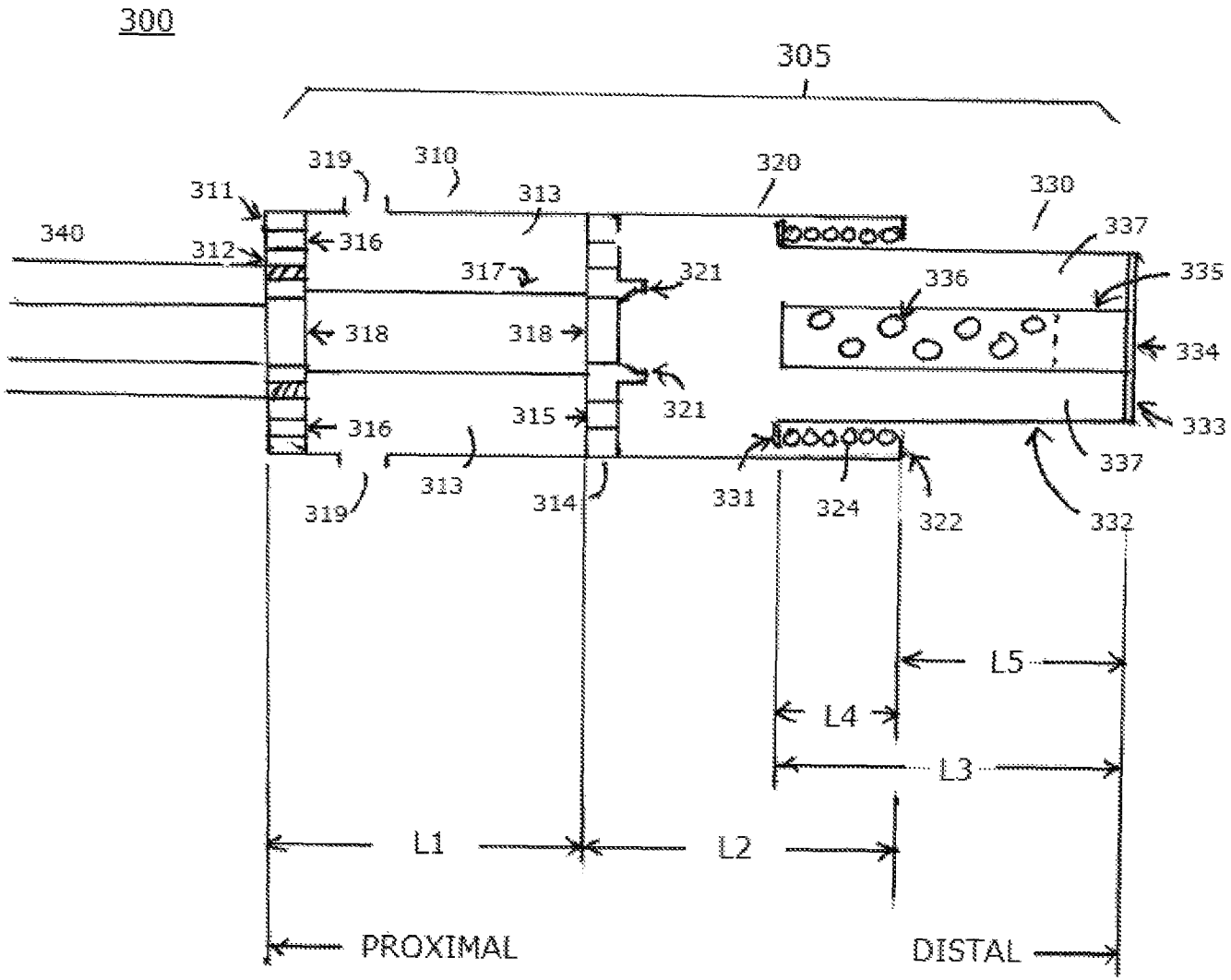
FIG. 3 shows block diagrams illustrating the major functional blocks of the Compact Space-saving Silencer (Suppressor) with the third chamber in the extended position.

Regarding FIG. 3, illustrates the novel silencer as shown in FIG. 2 in an expanded state. The expanding gases and projectile from the firearm causes the third chamber (330) to extend distally outward longitudinally along the bore axis. This extension allows the silencer (305) to accommodate the expanding gases in a controlled manner through the actions of the second chamber (320) and third chamber (330) and redirect these gases rearward back towards the first chamber (310). In the extended state, the third chamber (330) can be extended from the second chamber (320). The length (L3) is the length of the third chamber and (L4) is the length of the third chamber recessed inside the second chamber (320) and (L5) is the length of the third chamber (330) extended beyond the second chamber (320). The concentric spring (324) is shown in the compressed state and would apply pressure to retract the third chamber (330) as the gases pass rearward through to the first chamber (310). The gases trapped in the third chamber then can flow rearward through the distal end cap (314) with ports (315) radially along the end cap, then passes though the first chamber (310) and exits to the atmosphere through ports (316) on the distal end cap (311) or out the sides through holes (319).

The amount of volume expansion possible from the expanding third chamber relative to the second chamber in the case of a cylinder shape can be expressed approximately by the following formulas Volume of the Second Chamber[$VS1$]=(3.14)×(Radius of Second Chamber^2)×$L2$ Volume of Third Chamber extending outward[$VT1$]=(3.14)×(Radius of Third Chamber^2)×[$L5$ in FIG. 3]

One Ratio of expansion can be expressed as [VS1+VT1]/[VS1]

There are other factors such as the area of the compression spring (324) and area of the materials from the second inner tube (335) that may be subtracted for a more exact ratio, but the benefits can be generally derived with the formula above.

Empirical data shows that meaningful expansion benefits can occur at ratios of 130% with greater benefit occurring at 150%-175%, up to a theoretical limit approaching 200%. This novel invention structure indicates that the greater the volume expansion, the better the sound suppression with having a retractable chamber for space-saving benefits.

In the preferred embodiment, the elements of the silencer (305) are designed with inner tube elements (317), (321), and (335) with openings that are slightly larger than the projectile width. This allows the projectile to pass untouched as it travels from the barrel of the gun (340) through the silencer (305).

If a tighter aperture is desired to seal as much of the gases into the silencer, a washer-like "wipers" which have a central hole for passage of the projectile that has a slightly smaller diameter than the actual diameter of the projectile can be used at the last proximal point of the silencer on the third end cap location hole (334). This arrangement provides momentary gas sealing during the passage of the projectile through the series of wipers and chambers. The wipers are typically made of softer materials such as rubber so after several rounds are fired through the wipers; the hole is resized to barely touch the projectile but provide for a closer fit that can be achieved safely from a metal aperture.

In a second embodiment, the silencer (305) can be used to silence or suppress a shotgun that uses a cup and wad assembly for the shotgun shell. If a shotgun utilizes such a wad and cup ammunition, the silencer (305) apparatus can be used to silence or suppress the sound of the projectile. The overall structure as detailed for the silencer (305) in the first embodiment is used along with the following changes. The inside diameter of the first chamber end cap opening (318), inner tube (317), alignment guide ring (321) and third chamber inner tube (335) and hole (334) will be substantially and very closely manufactured to be the same inside diameter as the barrel (340) of the shotgun. This would allow an uninterrupted path of uniform diameter for the shotgun shell with the wad, cup, and shot configuration to pass through the barrel of the gun (340) and the silencer (305) freely. The uninterrupted and uniform diameter of the barrel with the silencer allows the shotgun shell to maintain its flight [and pellet] configuration until it exits the silencer (305). This alignment guide ring (321) can have a beveled or angled inner surface such that the inner tube (335) can be self-centered in the retracted position.

Figure 4:
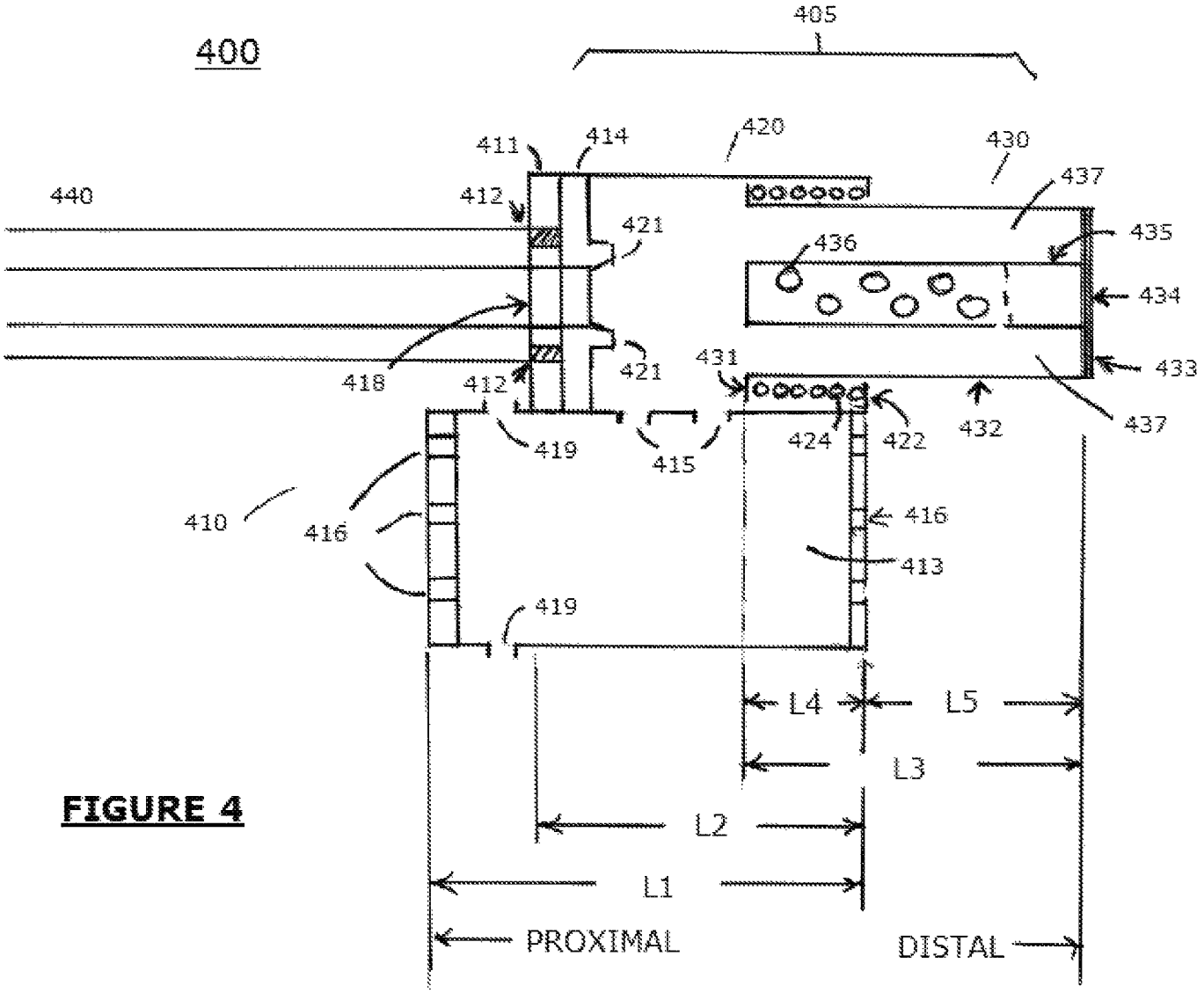
FIG. 4 shows block diagrams illustrating the major functional blocks of the Compact Space-saving Silencer (Suppressor) in another embodiment with the first chamber along-side the second chamber and with the third chamber in the extended position.

Regarding FIG. 4, in a third embodiment, the overall structure as detailed for the silencer (305) in the first embodiment is used along with the following changes for this alternate embodiment. The second chamber (420) is of cylindrical shape includes a threaded end cap (411) configured to be secured to threads (412) of a barrel of a firearm (440). The threaded end cap (411) may be employed for the securement of silencer apparatus to the barrel of the firearm, other methods may include quick disconnect methods such as a three lug mount or any other known method that would maintain the alignment and bore of the firearm to the silencer and maintain a straight through hole path for the projectile. As shown, the threaded end cap (411) has an annular aperture (418) which then connects to a second end cap (414). The second end cap (414) has a concentric alignment guide ring (421) which aligns the third chamber inner tube (435) with the bore line in the retracted position. This alignment guide ring (421) can have a beveled or angled inner surface such that the inner tube (435) can be self-centered in the retracted position. This allows for an accurate alignment of the various elements of the silencer to the bore line and ensures the projectile will pass through these elements freely.

The second chamber (420) has an opening with a flange or ridge (422) on the distal end concentric to the bore line to accommodate the third chamber (430), which can expand or contract longitudinally into the second chamber (420). The second cylinder has a concentric spring (424) which compresses the third chamber (430) into the second chamber (420). The spring (424) concentric with the second chamber (420) and third chamber (430) utilizes the flanges or ridges of the second chamber (422) and flanges or ridges of the third chamber (431) to hold the chambers in a normally retracted position.

The first chamber (410) can be of cylindrical or square or oval shape attached along-side the second chamber (420) and with openings (415) along-side the walls of the second chamber (420) into the first chamber (410), whereby the gases are flowed through the second chamber (420) and third chamber (430) and downward to the first chamber (410). In this embodiment, the projectile does not pass through the first chamber (410); the first chamber is attached to the side of the second chamber (420) and is used to port the gases. The first chamber (410) has vent holes (416) that can be placed on the ends caps or sides to allow the gases to exit in one of multiple directions.

The elements of the silencer (405) such as the aperture opening (418), alignment guide ring (421), third chamber inner tube (435), and end cap opening (434) are designed with openings that are slightly larger than the projectile width. This allows the projectile to pass untouched as it travels from the barrel of the gun (440) through the silencer (405).

In a fourth embodiment, the silencer (405) can be used to silence or suppress a shotgun that uses a cup and wad assembly for the shotgun shell. The elements as discussed in FIG. 4 and the third embodiment above are applicable as a base for the fourth embodiment along with the following differences. If a shotgun firearm utilizes shotgun shell ammunition with a wad and cup configuration, the silencer (405) apparatus can be used to silence or suppress the sound of the projectile. The changes from the third embodiment discussed above are, the inside diameter of the end cap opening (418), alignment cup (421) and third chamber inner tube (435) has substantially and very closely manufactured to be the same inside diameter as the barrel (440) of the shotgun. This would allow an uninterrupted path of uniform diameter for the shotgun shell in the wad and cup to pass through the barrel of the gun (440) and the silencer (405) through key elements such as end cap (411), ring (421), inner tube (435) and end cap opening (434) freely. The uninterrupted and uniform diameter of the barrel with the silencer allows the shotgun shell to maintain its flight [and pellet] configuration until it exits the silencer (405). This alignment guide ring (421) can have a beveled or angled inner surface such that the inner tube (435) can be self-centered in the retracted position. This allows for an accurate alignment of the various elements of the silencer to the bore line and ensures the projectile will pass through these elements freely.

Figure 5:
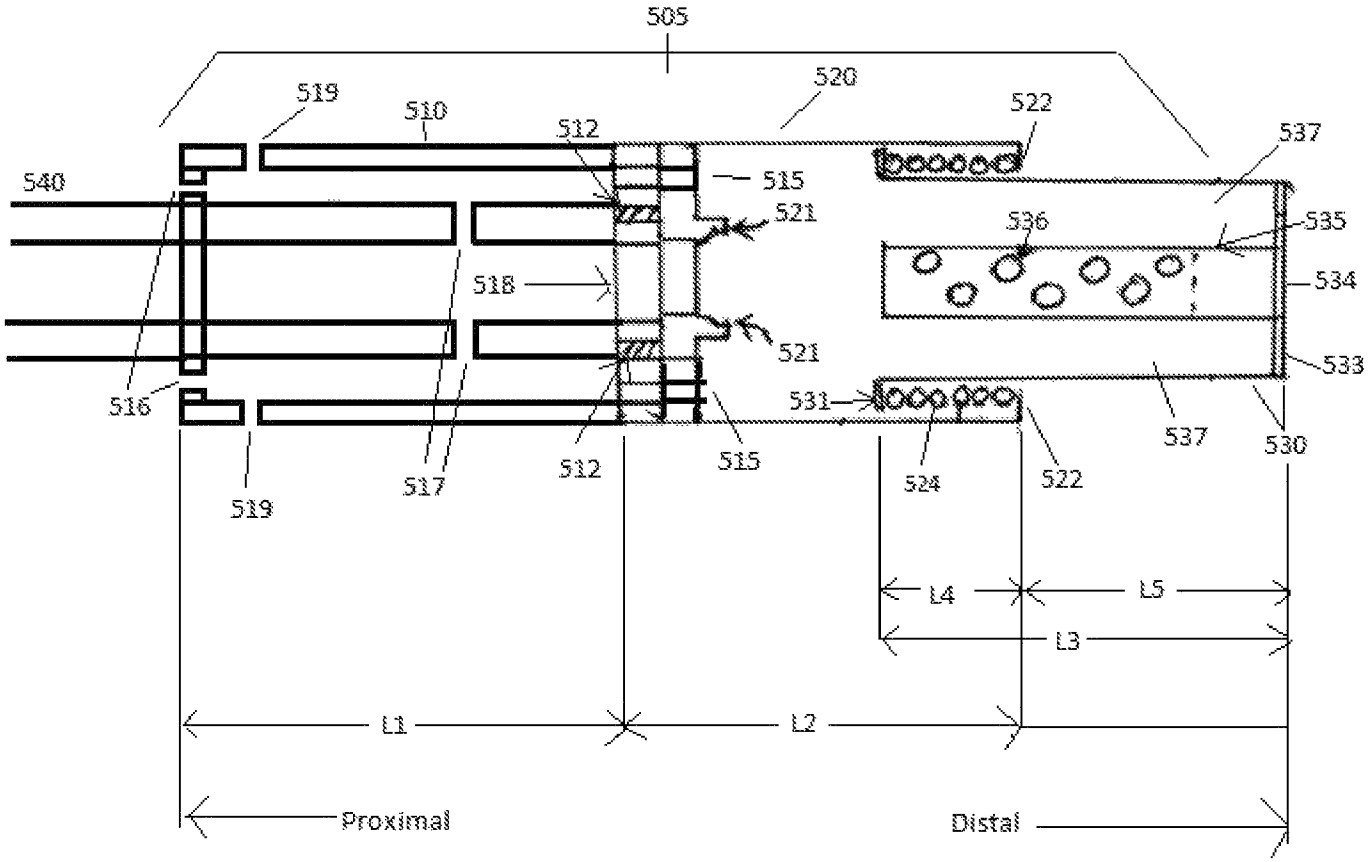
FIG. 5 shows block diagrams illustrating the major functional blocks of the Compact Space-saving Silencer (Suppressor) in another embodiment with the first chamber placed over and encompassing and concentric to the gun barrel further attached to the second chamber and with the third chamber in the extended position.

Regarding FIG. 5, in a fifth embodiment, the silencer (505) in the extended position has a first chamber (510) that is fitted over the barrel like a sleeve. The first chamber (510) extends proximally and radially over the gun barrel (540). The first chamber can be of cylindrical, oval, or square shape and hollow or filled with sound absorbent material such as a mesh of heat resistant material. The barrel (540) can be solid or ported with vent holes (517). The first chamber (510) can be solid or also contains vent holes (516 and 519) to channel the gasses from the barrel vent holes to the external environment. The first chamber (510) also has openings (515) allowing gasses to flow into the second chamber (520). The end cap opening (518), the alignment guide ring (521), the third chamber inner tube (535), and the hole (534) can have a diameter slightly wider than the inner diameter of the barrel (540) such that the projectile can pass freely through without touching the sides of the silencer (505). The inner tube (535) can have vent or bore holes (536). The first chamber (510) is connected to the second and third chamber (520 and 530 respectively). The silencer (505) consisting of the three chambers (510, 520, 530) is secured to the threads (512) of the barrel (540).

The second chamber (520) has an opening with a flange or ridge (522) on the distal end concentric to the bore line to accommodate the third chamber (530), which can expand or contract longitudinally into the second chamber (520). The second cylinder has a concentric spring (524) which compresses the third chamber (530) into the second chamber (520). The spring (524) concentric with the second chamber (520) and third chamber (530) utilizes the flanges or ridges of the second chamber (522) and flanges or ridges of the third chamber (531) to hold the chambers in a normally retracted position.

When the projectile is fired through the barrel (540), the fast moving air being pushed by the projectile vents out through holes (536) in the inner tube (535) to the internal volume of the second chamber (537). This increase in air within the second chamber (520) creates a higher air pressure, causing the third chamber (530) to extend outward distally from the second chamber (520). The compressed spring (524) exerts a force to retract the third chamber (530), pushing the air through the holes in the end cap (514) into the first chamber (510) and out of the holes (516 and 519) into the external environment.

Figure 6:
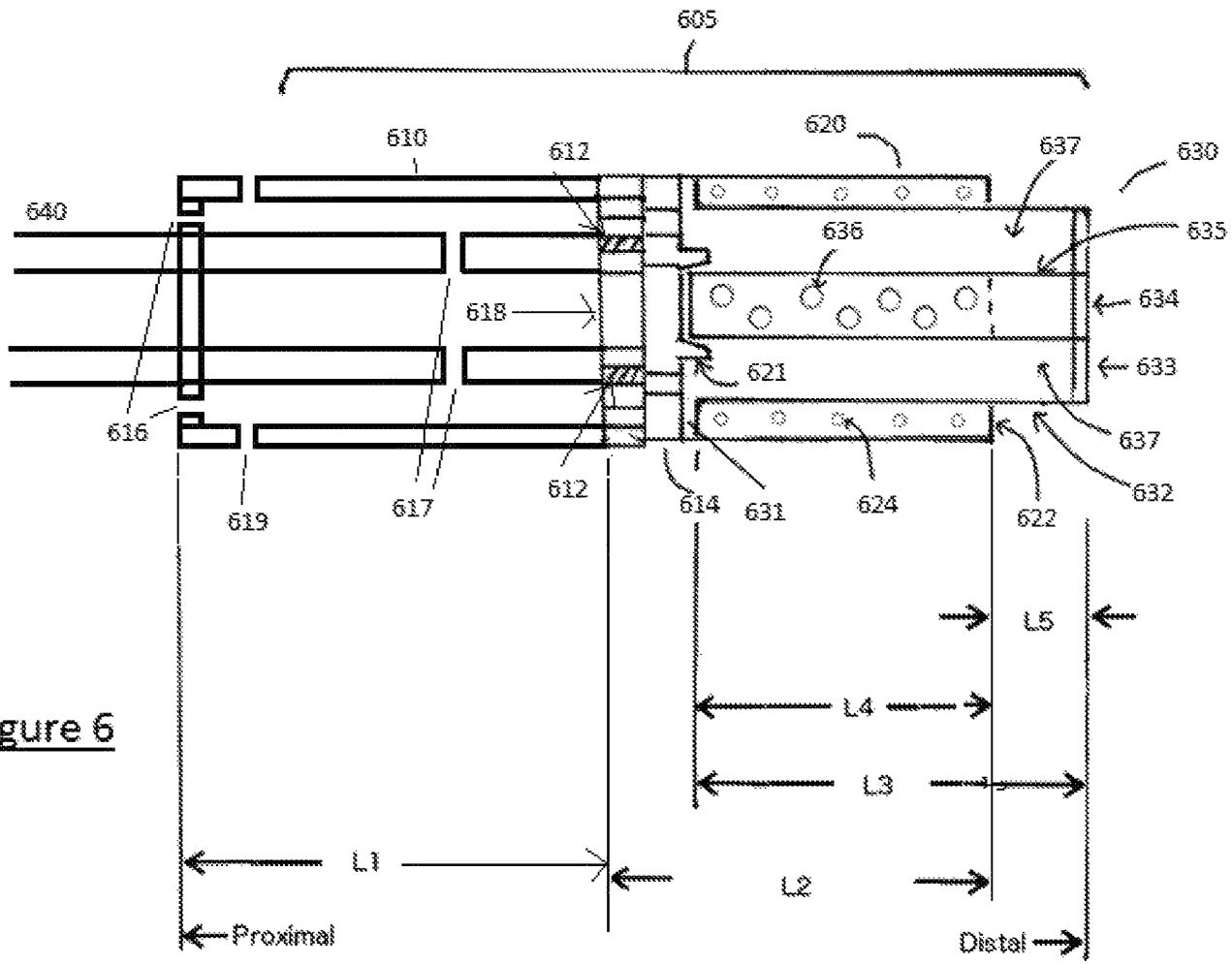
FIG. 6 shows block diagrams illustrating the major functional blocks of the Compact Space-saving Silencer (Suppressor) in another embodiment with the first chamber placed around and encompassing and concentric to the gun barrel attached to chamber 2 and with chamber 3 in the retracted position.

Regarding FIG. 6, illustrates the novel silencer (505) as shown in FIG. 5 in a retracted state (605). The silencer in the retracted position (605) shows the third chamber (630) inside the second chamber (620). The inner tube (635) rests on the alignment guide ring (621) to maintain alignment with the gun barrel (640) where the projectile travels uninterrupted through the barrel (640), the end cap (618), the guide ring (621), the inner tube (635), and the distal opening (634). The inner tube (635) can have vented or bore holes (636). This alignment guide ring (621) can have a beveled or angled inner surface such that the inner tube (635) can be self-centered in the retracted position.

Regarding FIG. 5, in a sixth embodiment, the silencer (505) in the extended position has a first chamber (510) that is fitted over the barrel like a sleeve. The end cap opening (518), the alignment guide ring (521), the third chamber inner tube (535), and the hole (534) can have substantially the same diameter as the inner diameter of the barrel (540).

This would allow an uninterrupted path of uniform diameter for the shotgun shell with the wad, cup, and shot configuration to pass through the barrel of the gun (640) and the silencer (605) freely. The uninterrupted and uniform diameter of the barrel with the silencer allows the shotgun shell to maintain its flight [and pellet] configuration until it exits the silencer (605). This alignment guide ring (621) can have a beveled or angled inner surface such that the inner tube (635) can be self-centered in the retracted position.

In order to address various issues and advance the art, the entirety of this application for COMPACT SPACE-SAVING GUN SILENCER (including the Cover Page, Title, Headings, Field, Background, Summary, Brief Description of the Drawings, Detailed Description, Claims, Abstract, Figures, Appendices, and otherwise) shows, by way of illustration, various embodiments in which the claimed innovations may be practiced. The advantages and features of the application are of a representative sample of embodiments only, and are not exhaustive and/or exclusive. They are presented only to assist in understanding and teach the claimed principles. It should be understood that they are not representative of all claimed innovations. As such, certain aspects of the disclosure have not been discussed herein. That alternate embodiments may not have been presented for a specific portion of the innovations or that further undescribed alternate embodiments may be available for a portion is not to be considered a disclaimer of those alternate embodiments. It will be appreciated that many of those undescribed embodiments incorporate the same principles of the innovations and others are equivalent. Thus, it is to be understood that other embodiments may be utilized and functional, logical, operational, organizational, structural and/or topological modifications may be made without departing from the scope and/or spirit of the disclosure.

As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any mechanical components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of mechanical conditions such as projectile and gases processing, may execute processes asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the innovations, and inapplicable to others.

In addition, the disclosure includes other innovations not presently claimed. Applicant reserves all rights in those presently unclaimed innovations including the right to claim such innovations, file additional applications, continuations, continuations in part, divisions, and/or the like thereof. As such, it should be understood that advantages, embodiments, examples, functional, features, logical, operational, organizational, structural, topological, and/or other aspects of the disclosure are not to be considered limitations on the disclosure as defined by the claims or limitations on equivalents to the claims. It is to be understood that, depending on the particular needs and/or characteristics of a COMPACT SPACE-SAVING GUN SILENCER, various embodiments of the said invention, may be implemented that enable a great deal of flexibility and customization. For example, aspects of the COMPACT SPACE-SAVING GUN may be adapted for a Pistol firearm. While various embodiments and discussions of the silencer have included rifles and shotguns, however, it is to be understood that the embodiments described herein may be readily configured and/or customized for a wide variety of other applications and/or implementations.

What is claimed is:

1. A silencer apparatus for suppressing the sound of a projectile fired from a firearm, the silencer apparatus comprising:

at least a first chamber and a second chamber, each of said chambers having a cylindrical, oval, or rectangular shape;

the first and second chambers being aligned longitudinally and sequentially along a bore line, wherein the bore line is coaxial with a longitudinal bore axis of a barrel of the firearm when the silencer apparatus is installed on the firearm;

the first chamber comprising a first end cap on a proximal end thereof, the first end cap having an opening formed there-through, and the first end cap having one of a screw mount, a three-lug twist disconnect system, or a mechanical connection system, for attaching the silencer apparatus to a muzzle end of the barrel of the firearm such that the bore line and longitudinal bore axis are aligned;

the first end cap being concentric with the bore line and including a concentric annular opening around the gun barrel and encompassing the gun barrel, wherein the first end cap is either solid or includes vent holes, a second end cap attached to the proximal end of the first chamber and adjacent to a distal side of the first end cap, the second end cap being concentric with the bore line and including a concentric annular opening, wherein the opening of the first end cap and the concentric annular opening of the second end cap are of the same size, wherein the second end cap is either solid or includes vent holes;

a guide ring formed on a distal end of the second end cap, the guide ring being concentric with the bore line and the concentric annular opening of the second end cap, and the guide ring being beveled along a distal side thereof and extending distally from the second end cap and functioning as an interface and alignment guide for a tube coming into contact with the guide ring along the bore line;

the first chamber further including a radially inward projecting first flange on a distal end of the first chamber and a spring, the spring being concentric with and internal to the first chamber, and the spring being connected with the first flange;

the second chamber having a smaller diameter or cross-sectional area than the first chamber, the second chamber being wholly or partially inserted within the first chamber;

the second chamber having a radially outwardly facing second flange on a proximal end thereof, the proximal end of the second chamber being disposed inside the first chamber;

the spring being concentric with and fitting between an outer surface of the second chamber and an inner surface of the first chamber; the spring being disposed between the first flange and the second flange such that the spring biases the second chamber into a retracted position in which the second chamber is retracted into the first chamber, and wherein the second chamber is movable relative to the first chamber longitudinally along the bore line from the retracted position to an expanded position, against the bias of the spring, when the second chamber is acted upon by expanding gases within the silencer apparatus;

the silencer apparatus further comprising a first inner tube disposed inside the second chamber and concentric with the bore line, the first inner tube being attached to a third end cap that is located at a distal end of the second chamber, the first inner tube having a diameter that is smaller than a diameter or cross-sectional area of the second chamber, and the diameter of the first inner tube being larger than the projectile;

the first inner tube being partially or fully perforated with holes along a length thereof to allow gases following the projectile along the bore line to vent from inside the inner tube into the first and second chambers;

an internal cavity of the second chamber, which is defined between an outer wall of the second chamber and the inner tube, containing one of empty space or sound absorbing material or mechanical baffles;

wherein a proximal end of the first inner tube contacts with the guide ring, such that the beveled portion of the guide ring causes the first inner tube to align concentrically with the bore line, when the second chamber is in the retracted position;

wherein the silencer apparatus allows a projectile fired from the firearm to travel along the bore line through the first end cap, second end cap, the first chamber, the first inner tube, the second chamber, and the third end cap, when the silencer apparatus is installed on the muzzle end of the barrel of the firearm;

wherein all the elements concentric to the bore line and along the path of the projectile of the silencer allow for a free flow path of the projectile and are sized with one of a same diameter as the barrel or a diameter just slightly larger than the projectile.

2. The silencer apparatus according to claim 1, further comprising:

a third chamber having a cylindrical, oval, or rectangular shape, extending proximally and radially around the gun barrel along the bore line, contained between the first end cap on a distal end thereof and a fourth end cap at the proximal end of the third chamber, the third chamber being defined by one of a solid cylindrical wall or a wall with a plurality of vent holes, an internal cavity of the third chamber between walls thereof containing one of empty space or sound absorbing material or mechanical baffles, and wherein the first and second end caps includes vent holes communicating with the first chamber to allow gases to pass from the third chamber to the first chamber;

wherein the interior cavity of the third chamber contains one of empty space or sound absorbing material or mechanical baffles;

wherein all the elements concentric to the bore line and along the path of the projectile of the silencer allow for a free flow path of the projectile and are sized with one of a same diameter as the barrel or a diameter just slightly larger than the projectile.

3. The silencer apparatus according to claim 1, further comprising:

wherein a wiper is disposed on a distal opening of the second chamber to provide a tighter seal between said distal opening and a projectile traveling through said distal opening.

4. The silencer apparatus according to claim 1, further comprising:

wherein the vent holes of the second end cap on the proximal end of the first chamber are varied in size to tune the gas flow for maximum distal expansion of the second chamber from the first chamber.

5. The silencer apparatus according to claim 1, further comprising:

a third chamber having a cylindrical, oval, or rectangular shape, being attached along at least a side of the first chamber and having a fourth end cap on a proximal end of the third chamber and a fifth end cap on a distal end of the third chamber;

the third chamber having a plurality of vent holes formed through the fourth end cap or the fifth end cap or along sides of the third chamber to allow gases to vent from an interior cavity of the third chamber to an external environment;

wherein the at least a side of the first chamber includes vent holes communicating with the third chamber to allow gases to pass from the first chamber to the third chamber;

wherein the interior cavity of the third chamber contains one or empty space or sound absorbing material or mechanical baffles.

6. The silencer apparatus according to claim 5, further comprising:

wherein the first and second end caps are collectively formed as a singular structure.

7. The silencer apparatus according to claim 1, further comprising:

a third chamber having a cylindrical, oval, or rectangular shape, the first, second, and third chambers being aligned longitudinally and sequentially along a bore line, wherein the bore line is coaxial with a longitudinal bore axis of a barrel of the firearm when the silencer apparatus is installed on the firearm;

the third chamber contained between the first end cap on a distal end thereof and the second end cap at the proximal end of the third chamber, the second end cap connecting the first and third chambers along the bore line, the third chamber comprising the first end cap on a proximal end thereof, the first end cap having an opening formed there-through, and the first end cap having one of a screw mount, a three-lug twist disconnect system, or a mechanical connection system, for attaching the silencer apparatus to a muzzle end of the barrel of the firearm such that the bore line and longitudinal bore axis are aligned;

the silencer apparatus further comprising a second inner tube disposed inside the third chamber and concentric with the bore line, the second inner tube being attached to the first end cap that is located at a proximal end of the third chamber, the second inner tube having a diameter that is smaller than a diameter or cross-sectional area of the third chamber, and the diameter of the second inner tube being larger than the projectile;

the second end cap attached to the proximal end of the first chamber and the second inner tube and the distal side of the third chamber, and the third chamber having a plurality of vent holes formed through the first end cap or along sides of the third chamber to allow gases to vent from an interior cavity of the third chamber to an external environment;

wherein the second end cap includes vent holes communicating with the first chamber to allow gases to pass from the third chamber to the first chamber;

wherein the interior cavity of the third chamber contains one or empty space or sound absorbing material or mechanical baffles;

wherein all the elements concentric to the bore line and along the path of the projectile of the silencer allow for a free flow path of the projectile and are sized with one of a same diameter as the barrel or a diameter just slightly larger than the projectile;

wherein the second tube is concentric to the bore line and along the path of the projectile of the silencer allow for a free flow path of the projectile and is sized with one of a same diameter as the barrel or a diameter just slightly larger than the projectile.

8. A method to silence or to suppress the sound of a projectile being fired from a firearm, the method comprising:

providing a silencer apparatus comprising:

at least a first chamber and a second chamber, each of said chambers having a cylindrical, oval, or rectangular shape;

the first and second chambers being aligned longitudinally and sequentially along a bore line, wherein the bore line is coaxial with a longitudinal bore axis of a barrel of the firearm when the silencer apparatus is installed on the firearm;

the first chamber comprising a first end cap on a proximal end thereof, the first end cap having an opening formed there-through, and the first end cap having one of a screw mount, a three-lug twist disconnect system, or a mechanical connection system, for attaching the silencer apparatus to a muzzle end of the barrel of the firearm such that the bore line and longitudinal bore axis are aligned;

the first end cap being concentric with the bore line and including a concentric annular opening around the gun barrel and encompassing the gun barrel, wherein the first end cap is either solid or includes vent holes, a second end cap attached to the proximal end of the first chamber and adjacent to a distal side of the first end cap, the second end cap being concentric with the bore line and including a concentric annular opening, wherein the opening of the first end cap and the concentric annular opening of the second end cap are of the same size, wherein the second end cap is either solid or includes vent holes;

a guide ring formed on a distal end of the second end cap, the guide ring being concentric with the bore line and the concentric annular opening of the second end cap, and the guide ring being beveled along a distal side thereof and extending distally from the second end cap and functioning as an interface and alignment guide for a tube coming into contact with the guide ring along the bore line;

the first chamber further including a radially inward projecting first flange on a distal end of the first chamber and a spring, the spring being concentric with and internal to the first chamber, and the spring being connected with the first flange;

the second chamber having a smaller diameter or cross-sectional area than the first chamber, the second chamber being wholly or partially inserted within the first chamber;

the second chamber having a radially outwardly facing second flange on a proximal end thereof, the proximal end of the second chamber being disposed inside the first chamber;

the spring being concentric with and fitting between an outer surface of the second chamber and an inner surface of the first chamber; the spring being disposed between the first flange and the second flange such that the spring biases the second chamber into a retracted position in which the second chamber is retracted into the first chamber, and wherein the second chamber is movable relative to the first chamber longitudinally along the bore line from the retracted position to an expanded position, against the bias of the spring, when the second chamber is acted upon by expanding gases within the silencer apparatus;

the silencer apparatus further comprising a first inner tube disposed inside the second chamber and concentric with the bore line, the first inner tube being attached to a third end cap that is located at a distal end of the second chamber, the first inner tube having a diameter that is smaller than a diameter or cross-sectional area of the second chamber, and the diameter of the first inner tube being larger than the projectile;

the first inner tube being partially or fully perforated with holes along a length thereof to allow gases following the projectile along the bore line to vent from inside the inner tube into the first and second chambers;

an internal cavity of the second chamber, which is defined between an outer wall of the second chamber and the inner tube, containing one of empty space or sound absorbing material or mechanical baffles;

wherein a proximal end of the first inner tube contacts with the guide ring, such that the beveled portion of the guide ring causes the first inner tube to align concentrically with the bore line, when the second chamber is in the retracted position;

wherein the silencer apparatus allows a projectile fired from the firearm to travel along the bore line through the first end cap, second end cap, the first chamber, the first inner tube, the second chamber, and the third end cap, when the silencer apparatus is installed on the muzzle end of the barrel of the firearm, wherein all the elements concentric to the bore line and along the path of the projectile of the silencer allow for a free flow path of the projectile and are sized with one of a same diameter as the barrel or a diameter just slightly larger than the projectile.

9. The method according to claim 8,
further comprising:
providing a silencer apparatus comprising:

a third chamber having a cylindrical, oval, or rectangular shape, extending proximally and radially around the gun barrel along the bore line, contained between the first end cap on a distal end thereof and a fourth end cap at the proximal end of the third chamber, the third chamber being defined by one of a solid cylindrical wall or a wall with a plurality of vent holes, an internal cavity of the third chamber between walls thereof containing one of empty space or sound absorbing material or mechanical baffles, and wherein the first and second end caps includes vent holes communicating with the first chamber to allow gases to pass from the third chamber to the first chamber;

wherein the interior cavity of the third chamber contains one of empty space or sound absorbing material or mechanical baffles;

wherein all the elements concentric to the bore line and along the path of the projectile of the silencer allow for a free flow path of the projectile and are sized with one of a same diameter as the barrel or a diameter just slightly larger than the projectile.

10. The method according to claim 8,
further comprising:
providing a silencer apparatus comprising:

wherein a wiper is disposed on a distal opening of the second chamber to provide a tighter seal between said distal opening and a projectile traveling through said distal opening.

11. The method according to claim 8,
further comprising:
providing a silencer apparatus comprising:

wherein the vent holes of the second end cap on the proximal end of the first chamber are varied in size to tune the gas flow for maximum distal expansion of the second chamber from the first chamber.

12. The method according to claim 8,
further comprising:
providing a silencer apparatus comprising:

a third chamber having a cylindrical, oval, or rectangular shape, being attached along at least a side of the first chamber and having a fourth end cap on a proximal end of the third chamber and a fifth end cap on a distal end of the third chamber;

the third chamber having a plurality of vent holes formed through the fourth end cap or the fifth end cap or along sides of the third chamber to allow gases to vent from an interior cavity of the third chamber to an external environment;

wherein the at least a side of the first chamber includes vent holes communicating with the third chamber to allow gases to pass from the first chamber to the third chamber;

wherein the interior cavity of the third chamber contains one or empty space or sound absorbing material or mechanical baffles.

13. The method according to claim 12,
further comprising:
providing a silencer apparatus comprising:

wherein the first and second end caps are collectively formed as a singular structure.

14. The method according to claim 8,
further comprising:
providing a silencer apparatus comprising:

a third chamber having a cylindrical, oval, or rectangular shape, the first, second, and third chambers being aligned longitudinally and sequentially along a bore line, wherein the bore line is coaxial with a longitudinal bore axis of a barrel of the firearm when the silencer apparatus is installed on the firearm;

the third chamber contained between the first end cap on a distal end thereof and the second end cap at the proximal end of the third chamber, the second end cap connecting the first and third chambers along the bore line, the third chamber comprising the first end cap on a proximal end thereof, the first end cap having an opening formed there-through, and the first end cap having one of a screw mount, a three-lug twist disconnect system, or a mechanical connection system, for attaching the silencer apparatus to a muzzle end of the barrel of the firearm such that the bore line and longitudinal bore axis are aligned;

the silencer apparatus further comprising a second inner tube disposed inside the third chamber and concentric with the bore line, the second inner tube being attached to the first end cap that is located at a proximal end of the third chamber, the second inner tube having a diameter that is smaller than a diameter or cross-sectional area of the third chamber, and the diameter of the second inner tube being larger than the projectile;

the second end cap attached to the proximal end of the first chamber and the second inner tube and the distal side of the third chamber, and the third chamber having a plurality of vent holes formed through the first end cap or along sides of the third chamber to allow gases to vent from an interior cavity of the third chamber to an external environment;

wherein the second end cap includes vent holes communicating with the first chamber to allow gases to pass from the third chamber to the first chamber;

wherein the interior cavity of the third chamber contains one or empty space or sound absorbing material or mechanical baffles;

wherein the second tube is concentric to the bore line and along the path of the projectile of the silencer allow for a free flow path of the projectile and is sized with one of a same diameter as the barrel or a diameter just slightly larger than the projectile.

* * * * *